US006662502B2

(12) United States Patent
Janutta et al.

(10) Patent No.: US 6,662,502 B2
(45) Date of Patent: Dec. 16, 2003

(54) MOVABLE PARTITION WITH A PLURALITY OF LATERALLY MOVABLE WALL ELEMENTS

(75) Inventors: Reinhard Janutta, Verl (DE); Ernst Udo Blöbaum, Leopoldshöhe (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/927,088

(22) Filed: Aug. 9, 2001

(65) Prior Publication Data

US 2002/0066228 A1 Jun. 6, 2002

Related U.S. Application Data

(63) Continuation-in-part of application No. PCT/EP00/12068, filed on Dec. 1, 2000.

(30) Foreign Application Priority Data

Dec. 10, 1999 (DE) ..... 199 59 825

(51) Int. Cl.[7] ..... E05D 15/48
(52) U.S. Cl. ..... 49/143; 49/176; 49/127
(58) Field of Search ..... 49/125, 127, 142, 49/143, 158, 163, 176, 177, 188

(56) References Cited

U.S. PATENT DOCUMENTS 1,426,170 A * 8/1922 Frantz ..... 49/260
1,583,443 A * 5/1926 Casey ..... 49/37
3,090,424 A * 5/1963 Carlo ..... 160/23.1
3,654,732 A * 4/1972 Schacht ..... 49/127
3,685,223 A * 8/1972 Sherwood ..... 52/64
4,182,080 A * 1/1980 Naylor ..... 49/410
5,426,892 A * 6/1995 Haab et al. ..... 49/189

FOREIGN PATENT DOCUMENTS

| | | |
|---|---|---|
| DE | 2410623 | 9/1975 |
| DE | 19753132 | 6/1999 |
| EP | 0601326 | 7/1996 |
| FR | 2650620 | 2/1991 |

* cited by examiner

*Primary Examiner*—Gregory J. Strimbu
(74) *Attorney, Agent, or Firm*—Nils H. Ljungman & Associates

(57) ABSTRACT

A movable partition system with a plurality of wall elements that are suspended from a guide rail and can be laterally moved to form a wall to close a space in a building. One of the wall elements is realized in the form of a door that can be operatively connected to a door closer that is mounted in a stationary manner to the guide rail. When the wall elements are moved to a closed position, the door is engaged with the door closer so as to pivot the door. When the wall elements are moved out of the closed position, the door is disengaged from the door closer. In addition, the door is prevented from pivoting by a rocker arm during movement of the wall elements, which rocker arm is rotated out of the way of the door when the wall elements are in the closed position to permit pivoting of the door.

20 Claims, 5 Drawing Sheets

MOVABLE PARTITION WITH A PLURALITY OF LATERALLY MOVABLE WALL ELEMENTS

This is a CIP of PCT/EP 00/12068 Dec. 1, 2000

BACKGROUND OF THE INVENTION

1. Field of the Invention

This invention relates to a movable partition with a plurality of wall elements that can be displaced laterally by means of rollers guided in a slide rail or runner, at least one of which wall elements is realized in the form of a door element that can be actuated by means of an automatic drive or door closer.

2. Background of the Invention

On a movable partition of this type that is not guided in the vicinity of the floor, e.g. as described in European Patent 0 601 326 B1, the door closer associated with the door element is installed in a concealed manner inside a frame structure of the door element in its top, horizontal profile, so that only its drive shaft pointing toward the floor projects out of the frame structure and can be connected with the facing fitting of the door element by means of a transverse coupling pin.

In this manner, when the movable partition is displaced, the door closer, which is constantly effectively connected with the door element, is moved along with the wall elements of the movable partition that comprises additional wall elements.

A construction of the type described above is complicated, because, among other things, it is difficult for the suspension of the door element to absorb the torque that is applied by the door closer, which suspension can be displaced by means of rollers, especially because each wall or door element has its own drive mechanism for its displacement.

The weight of the door elements that must be moved and thus their inertia is also increased, which represents a disadvantage in terms of the displacement processes.

The realization of the prior art is therefore expensive.

Federal Republic of Germany Patent 24 10 623 A1 describes a movable partition, the individual wall elements of which are guided on the top and bottom, are driven by a common drive mechanism and can be moved into the open and/or closed position by folding.

On a movable partition of this type, the building opening can only be completely open or completely closed. During cold weather, however, it is desirable to be able to open or close at least one wall element independently when the movable partition is closed, e.g. a wall element that is realized in the form of a swinging door.

OBJECT OF THE INVENTION

The object of the invention is therefore to resolve these problems by a new configuration and realization of a movable partition that comprises a plurality of wall elements, at least one of which is realized in the form of a door element that can be actuated by a door closer.

SUMMARY OF THE INVENTION

On the basis of the movable partition of the prior art described in European Patent 0 601 326 B1, this invention teaches that an automatic swinging door drive mechanism or the door closer is stationary with reference to the movable wall elements of the movable partition, that actuation means located between the swinging drive/door closer and door element are realized in the form of a linkage that is automatically activated or deactivated when the wall elements are displaced, and that there is a blocking mechanism by means of which the door element is held in the displacement position while it is being displaced, and which releases the swinging door drive or the door closer when the door element is moved into the active position.

Additional features of the invention are disclosed in the dependent claims.

As a result of the stationary installation of the drive device that opens and closes the door element, which drive device is realized in the form of a controllable door closer, there is vibration-free operation of the associated drive motor and its geared parts and of the transmission linkage, which is extraordinarily advantageous in terms of secure and reliable operation over long periods.

The loads on the suspensions of the wall elements that serve as the door elements are also reduced because the weight of the drive device can now be supported by the building. This arrangement improves the smooth running of the movable partition, because now all of the wall elements weigh approximately the same. The absorption of the torque that is applied by the door closer during the opening and closing of the wall element that is realized in the form of the door element by the building is simple, safe and reliable, and that in turn has a favorable effect on operational safety and reliability. The supply of electric power to the drive system, which can operate both electro-mechanically and electro-hydraulically, is also significantly simpler.

The realization of the drive device as taught by the invention also makes it possible to retrofit the device on existing movable partitions.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiment illustrated more or less schematically in the accompanying drawings, in which.

DESCRIPTION OF THE PREFERRED EMBODIMENT

Figure 1:
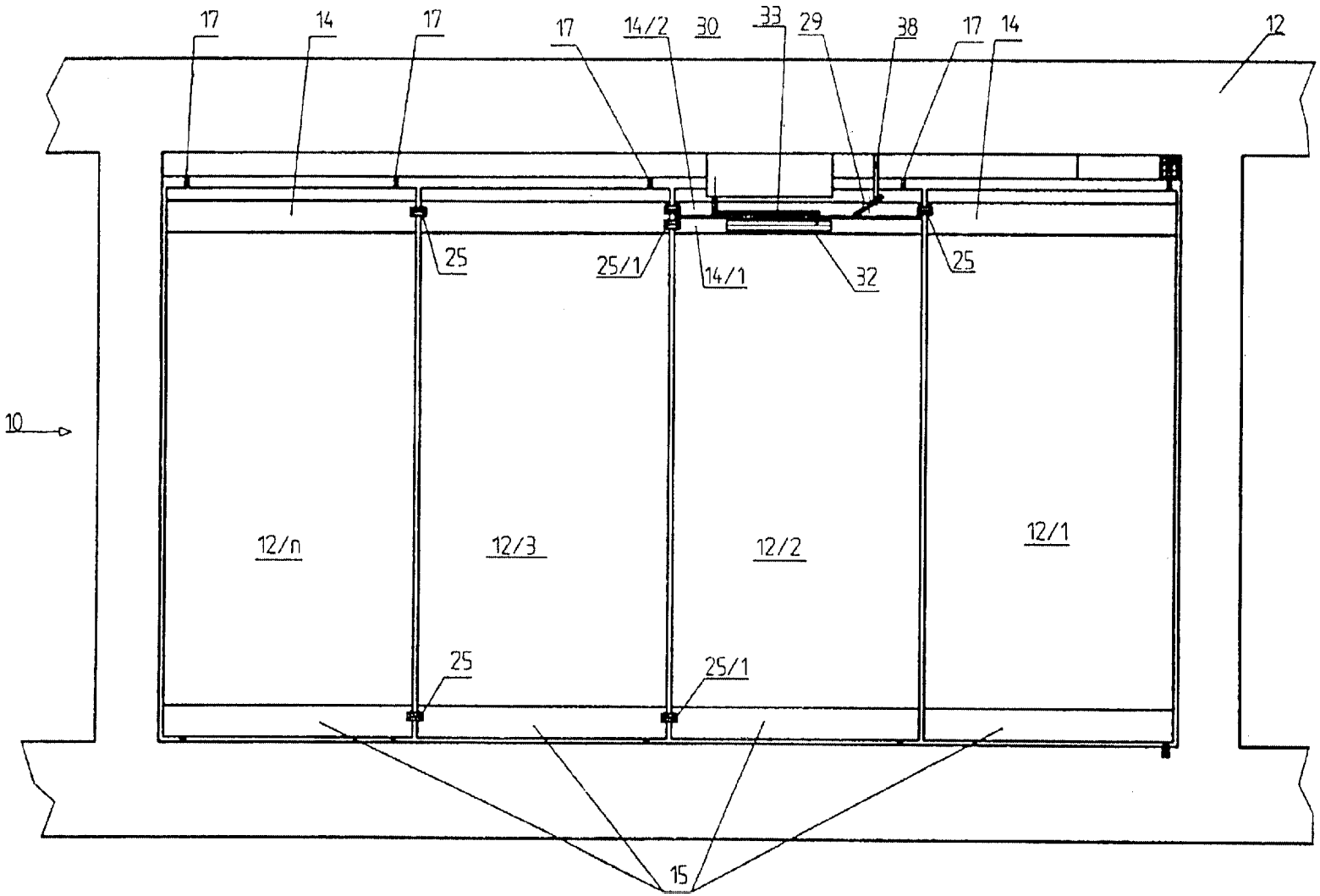
FIG. 1 is a view of a movable partition that comprises a plurality of wall elements to close a building opening. The movable partition is shown in the closed position along with the drive device claimed by the invention for a wall element that is realized in the form of a door element.
Figure 2:
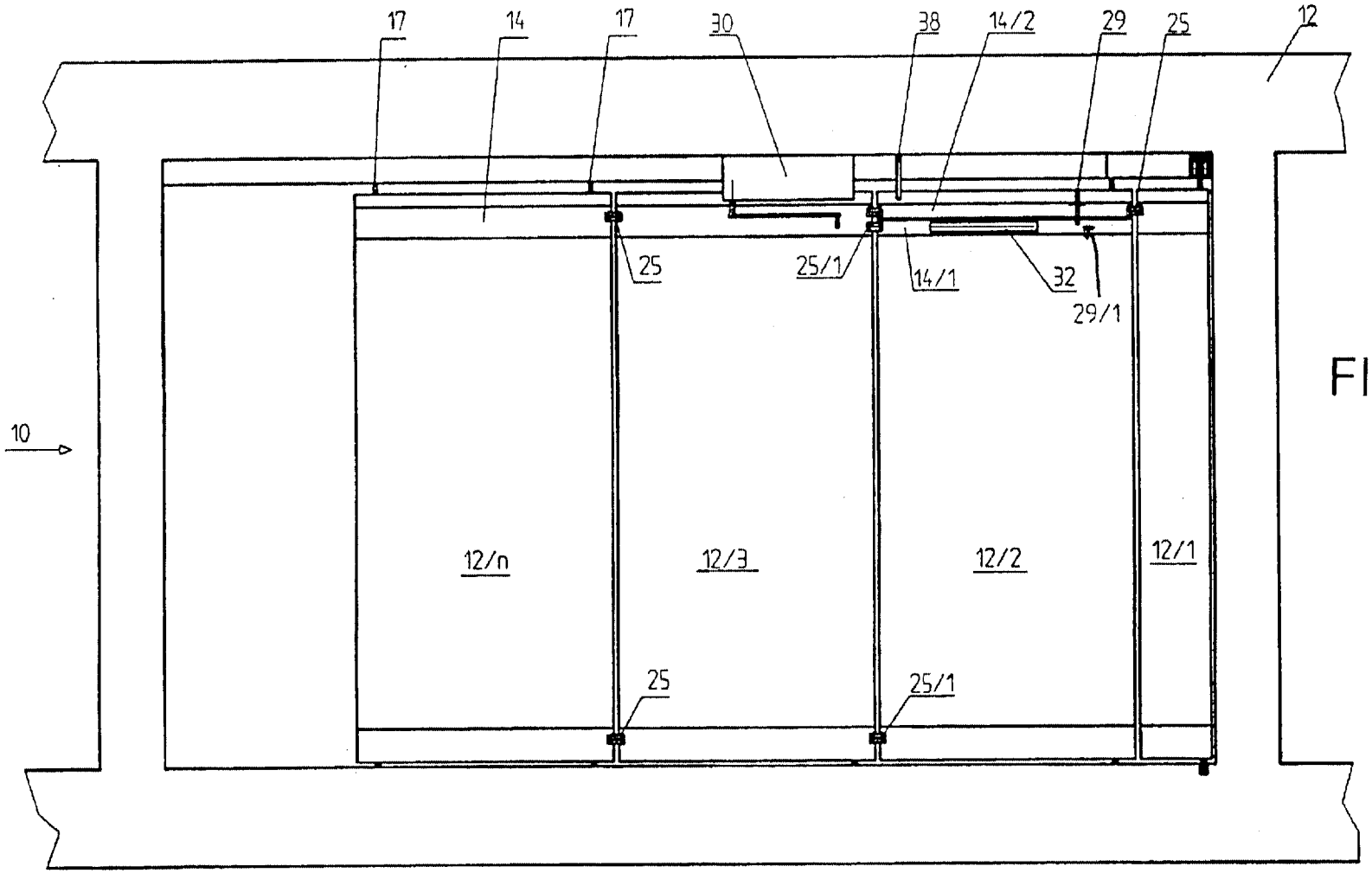
FIG. 2 is a view as in FIG. 1 during the movement of the movable partition into the open position.

A movable partition 10, as illustrated in FIGS. 1 and 2, comprises a plurality of laterally movable wall elements 12/1 to 12/n, the upper edges of which are each enclosed by a support profile 14 and the lower edges of which are covered by a cover profile 15 if the wall elements are realized in the form of all-glass elements. The support profiles 14 have support pins 17, by means of which the wall elements 12/1 to 12/n are each connected with a drive slide 23 that is guided in a guide rail 20 by means of rollers 21 and guide rollers 22, so that the height of the elements can be adjusted. Each drive slide 23 has a drive motor, not shown in the figures, by means of which each wall element can be moved along the guide rail. The guide rail 20 is connected to the ceiling of the space that is to be enclosed by the movable partition. It is also possible to connect the wall elements 12/1 to 12/n to one another and to move them by means of a drive.

Figure 3:
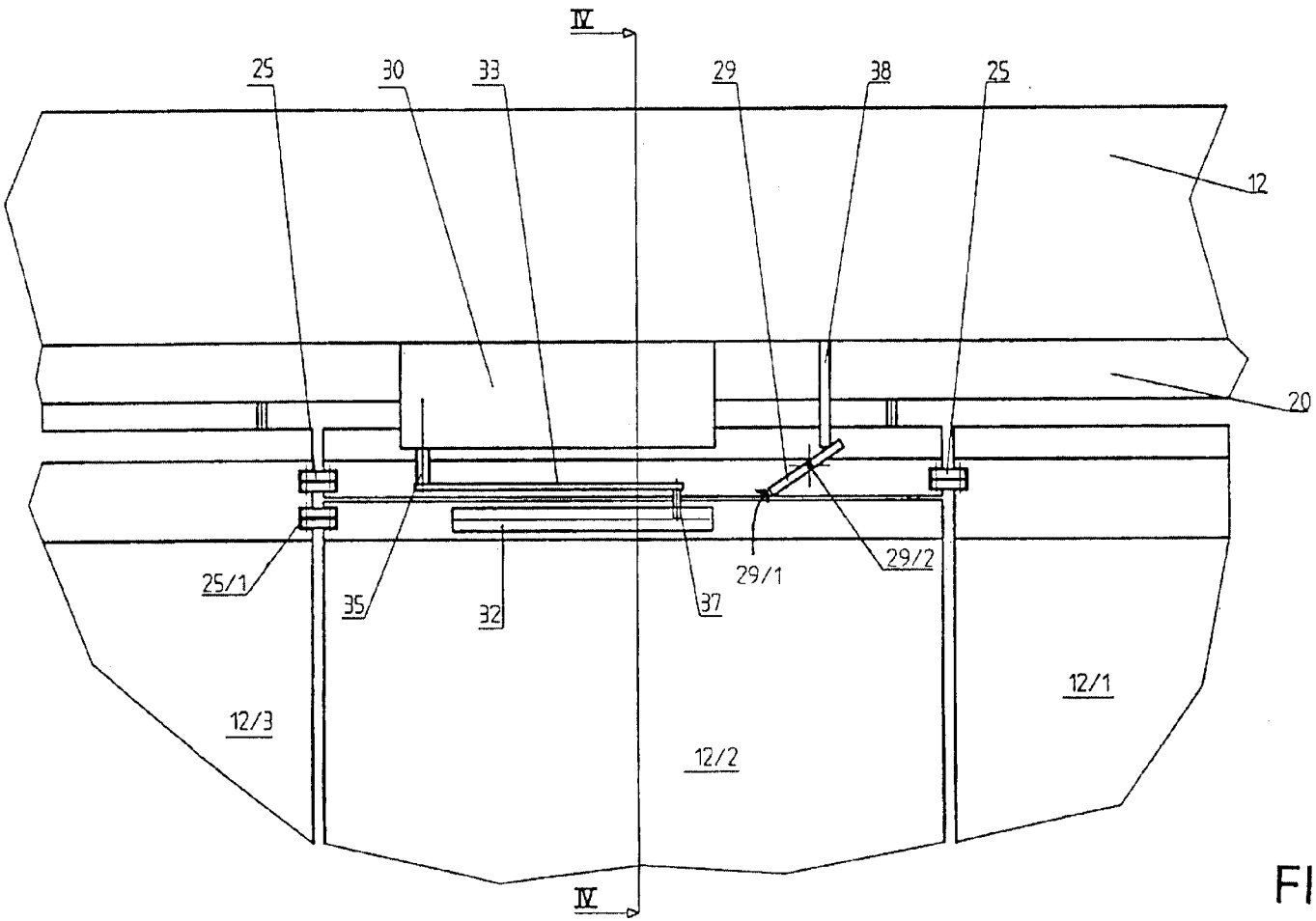
FIG. 3 is a detail on a larger scale from FIG. 1, showing the drive device.

The building, which is only indicated in. FIGS. 1–3, is designated 12 overall.

On the facing longitudinal edges of the individual wall elements 12/1 to 12/n there are fittings 25, by means of which the wall elements 12/1 to 12/n are connected to each other in an articulated fashion. The fittings 25/1 between the wall elements 12/2 and 12/3 are realized in the form of rotational or pivoting fittings, which make it possible for a wall element 12/2 that is realized in the form of a door element to pivot in a manner that is described in greater detail below, for which purpose a controllable, stationary drive 30 that acts as a door closer is used. The slide rail 20 is associated with a frame profile 27—see FIG. 4—by means of which the slide rail and the support pins 17 are concealed on the visible side.

To realize the wall element 12/2 in the form of a door element, i.e., a swinging door, the associated support profile 14 is designed in two parts, and consists of identical partial profiles 14/1 and 14/2. See FIG. 4 for details of these parts.

The upper support profile 14/2 is connected by means of the support pins 17 with the associated drive slides 23, while the lower partial profile 14/1 encloses the upper edge of the wall element 12/2 that serves as the door element. The upper partial profile 14/2 is connected by means of the fittings 25 with the wall elements 12/1 and 12/3; these fittings therefore provide the connection of all the wall elements 12/1 to 12/n to one another. Associated with the upper partial profile 14/2 there is also a fixed stop 28 (See FIG. 4), against which, when the movable partition is closed, the wall element 12/2 that serves as the door element is in snug contact by means of its partial profile 14/1.

Figure 4:
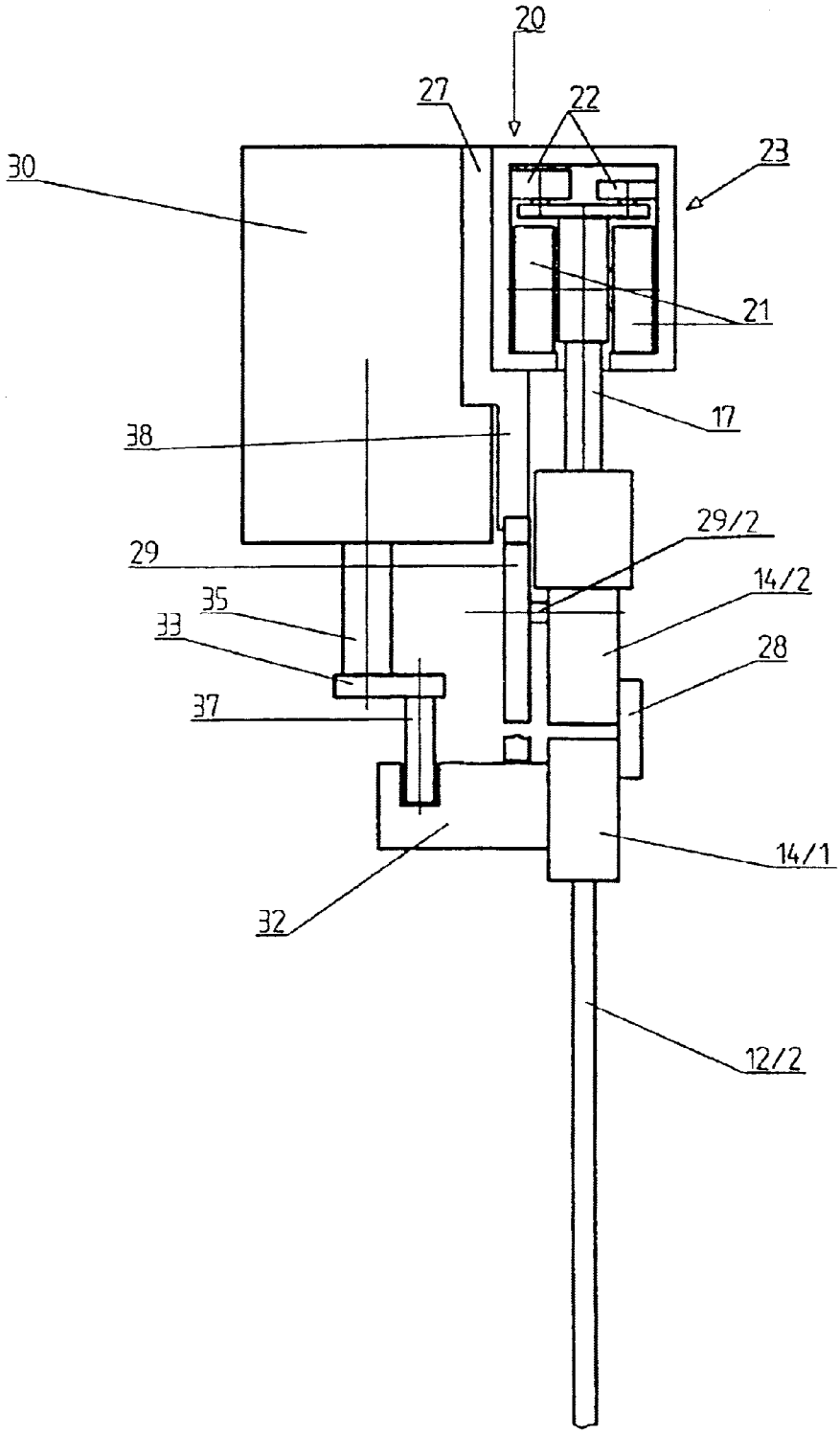
FIG. 4 is a section along Line IV—IV in FIG. 3.

The upper partial profile 14/2 also carries a rotationally mounted lever arm or rocker arm 29, as shown particularly clearly in FIG. 4, which is spring-loaded in the idle position as shown in FIG. 2, and is in contact with its terminal portion 29/1 in front of the lower partial profile 14/1 of the wall element 12/2 that acts as the door element, and thus keeps the wall element stationary in the plane of the movable partition. Spring-biased axle 29/2 provides the force to rotate rocker arm 29.

The lower partial profile 14/1 is connected by means of the one rotational fitting 25/1 with the neighboring wall element 12/3, while a second rotational fitting 25/1 is engaged in the lower portion of this wall element.

The above mentioned drive 30 is installed in a stationary manner on the frame profile 27 in the vicinity of the wall element 12/2 that serves as the door element, and in particular in the position assumed by this wall element when the movable partition is closed—See FIG. 1. In this area, on the lower partial profile 14/1 of the wall element 12/2, slide rail 32 of a slide rail linkage associated with the drive 30 is fastened, whereby sliding rail arm 33 sits on a drive shaft 35 of the drive 30, and when the movable partition is closed, is engaged by means of a stud or coupling pin 37 in slide rail 32, as shown clearly in FIG. 4.

Finally, rocker arm 29 is associated with a stationary stop 38 which is fastened to the frame profile 27 in the vicinity of the wall element 12/2 that serves as the door element and projects into the path of movement of rocker arm 29 which is connected to the upper partial profile 14/2.

Figure 5:
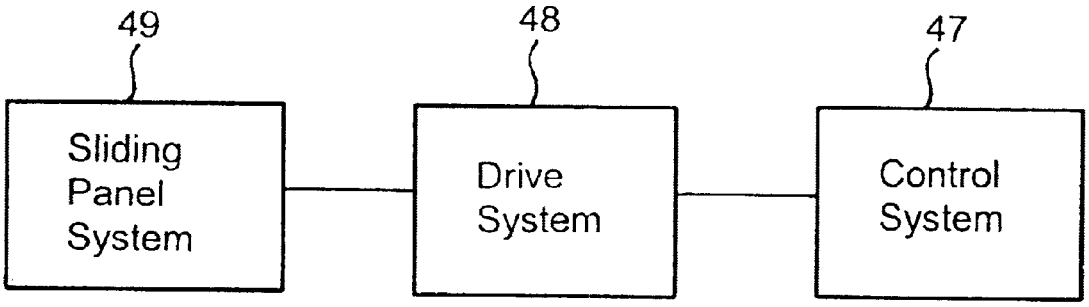
FIG. 5 is schematic view of the major components of the invention.

The operation of the device described above is as follows:

In the closed position of the movable partition illustrated in FIG. 1, the drive 30 with the slide rail arm 33 is engaged by means of stud or coupling pin 37 in the slide rail 32 and is, therefore, effectively connected with the wall element 12/2 that acts as the door element, and which is pivotably connected to the wall element 12/3 by means of the rotational fitting 25/2. At the same time, by means of stationary stop 38, the rocker arm 29 has been pivoted into its inactive position—see FIGS. 1, 3 and 4—so that the wall element 12/2, which is in the form of a door element, can be opened and closed in the known manner by means of the drive 30. For this purpose there is a sensor control system, which is not shown in FIGS. 1–4 because it is not part of the invention, but which can, for example, be of the type described and illustrated in the DORMA promotional brochure ED 300 "Automatischer Dreflügelantrieb" ["Automatic Swinging Door Drive System"]. FIG. 5 shows the relationship of such a control system with the drive system and the partition elements.

If, when the wall element 12/2 is closed, which can be verified by means of a sensor control system which is also not shown in the accompanying drawings, and the movable partition is moved by means of the drive slide 23 into the open position, as illustrated partly in FIG. 2, the rocker arm 29 and the slide rail arm 33 slide out of their positions illustrated in FIG. 1. The rocker arm 29, by means of contact with its terminal portion 29/1 which lies in front of the profile part 14/1, thereby blocks any pivoting movement of the wall element 12/2 which is being used as the door element. The drive 30 is also deactivated as a result of the exit of coupling pin 37 from the slide rail 32.

The wall elements 12/1 to 12/n of the movable partition are, therefore, now practically rigid and can be moved in the conventional manner by means of their drive slides 23 into their parked position, so that the building opening that was previously covered by the movable partition is now exposed. When the movable partition is moved into the closed position, as illustrated in FIG. 1, on the other hand, the active status illustrated in FIG. 4 of the device described above is automatically reestablished, because the coupling pin 37 of the slide rail arm 33 is engaged in the slide rail 32 and the spring-loaded rocker arm 29 is pivoted by means of the stationary stop 38 into its inactive position, so that the drive is once again operational. Preferably, the slide rail arm 33 is also spring loaded so that the coupling pin 37 will align with the slot in the slide rail 31 configured to receive the coupling pin 37 upon the door 12/2 moving into the closed position of the partition system.

Of course, the drive can be associated with any or all of the wall elements of the movable partition, without thereby going beyond the teaching of the invention, which is the automatic coupling and uncoupling.

One feature of the invention resides broadly in a movable partition with a plurality of wall elements (12/1–12/n) guided so that they can move laterally in a support profile (14), at least one of which wall elements (12/2) is realized in the form of a door element that can be actuated by means of a door closer (30) characterized by the fact that the door closer drive (30) is stationary with reference to the movable wall elements (12/1 to 12/n), that the actuation means located between the door closer drive (30) and the wall element (12/2) that is used as a door element are realized in the form of a linkage (32, 33, 37) that automatically becomes active or inactive when the wall elements are moved, and that there is a blocking element (rocker arm 29), by means of which the wall element (12/2) that serves as the door element is held in the rest position during movement of the movable partition, and is released when transferred or moved into the active position with the door closer drive (30).

Another feature of the invention resides broadly in a movable partition characterized by the fact that the actuation means that are located between the door closer drive (30) and the wall element (12/2) that serves as a door element are realized in the form of a slide rail linkage, the slide rail (32) of which is associated with the wall element (12/2) that functions as the door element and the slide rail arm (33) of which is associated with the door closer drive (30).

Yet another feature of the invention resides broadly in a movable partition characterized by the fact that the blocking element is realized in the form of the spring-loaded rocker arm (29) that is associated with the wall element (12/2) that serves as the door element, and with which a stationary stop (38) is associated as an actuator element. In other words, whenever the wall elements (12/1–12/n) close-off the area of the building to be partitioned and the door element (12/2) is properly coupled with the door closer drive (30) by means of the coupling linkage (32, 33, 37), the door element (12/2) is free to open or close by rotation on its fittings (25/1) because the rocker arm (29) is in contact with the stationary stop (38) so that it is rotated to a canted position and does not obstruct rotational movement of the door element (12/2), but whenever those wall elements (12/1–12/n) are opened or in the process of being opened, the rocker arm (29) looses contact with the stationary stop (38) so that it returns to its vertical blocking posture resulting in an inability of the door element (12/2) to rotate or pivot.

Still another feature of the invention resides broadly in a movable partition characterized by the fact that the wall element (12/2) that serves as the door element is pivotably connected to the neighboring wall element (12/3) by means of rotational fittings (25/2) and has a support profile (14/1, 14/2) that is realized in two parts, the partial profiles (14/1 and 14/2) of which can move rotationally relative to each other and can be fixed in position in the parallel displaced position, the lower partial profile (14/1) of which is associated with the wall element.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 199 59 825.8, filed on Dec. 10, 1999, having inventors Reinhard JANUTTA and Ernst Udo BLÖBAUM, and DE-OS 199 59 825.8 and DE-PS 199 59 825.8, and International Application No. PCT/EP00/12068, filed on Dec. 1, 2000, having WIPO Publication No. WO01/42604 A 1 and inventors Reinhard JANUTTA and Ernst Udo BLÖBAUM, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus function clauses are intended to cover the structures described herein as performing the recited function and not only structural equivalents but also equivalent structures.

One feature of the invention resides broadly in a movable partition system comprising: a plurality of glass wall elements being configured to be connected to one another along longitudinal edges to provide a continuous wall-like partition for a space of a building and thus provide a closed position and a position other than said closed position to provide an opened condition or position, each of said connected wall elements guided so that they move laterally in association with a support profile; a door closer; at least one of said connected wall elements comprising a glass door that can be actuated by means of said door closer; a guide rail configured to be attached to the ceiling of the building space to be partitioned; an arrangement comprising: support profiles configured to enclose the upper edges of each wall element to suspend said connected wall elements from said guide rail, the support profile for said door being in two parts, a lower partial profile which is associated with said door and comprises a slide rail and a rotational fitting for pivotally connecting said door to its neighboring wall element, and an upper partial profile which comprises support pins to suspend said door from said guide rail; a spring-loaded, rotationally-mounted rocker arm to maintain said door in a closed and inactive status position upon lateral movement of said wall elements to said opened condition and which releases said door upon movement of said wall elements into said closed position to put said door into an active position with said door closer and to permit said door to open and close, and fittings to connect said door to its corresponding wall element; one or more drives associated with said guide rail to move said wall elements laterally to, alternatively, open and partition said space; said door closer comprising a door closer drive which is configured to be stationary with reference to the movable wall elements and is configured to be affixed to said guide rail in the vicinity of said door upon lateral movement of said wall elements to said closed position to partition said space; a door stop to arrest the rotational movement of said door upon activation of said door closer; an actuation linkage which is configured to be stationary with reference to the movable door, is configured to be located between said door closer and said door, comprises a slide rail arm having an integral coupling pin connected to the drive shaft of said door closer drive; a slide rail; said coupling pin being capable of engaging and disengaging said slide rail, being configured to be mounted on said door, upon lateral movement of said wall elements; and a stationary stop configured to be fastened to said guide rail upon said guide rail being attached to the ceiling and protruding into the projected path of travel of said rocker arm with respect to said guide rail upon lateral movement of the connected wall elements so that said stationary stop contacts said rocker arm and rotates said rocker arm to a canted position upon lateral movement of said door into an active position with said door closer in order to allow pivoting of said door and loses contact with said rocker arm and permitting rotation of said rocker arm to a substantially vertical position upon lateral movement of said door in its corresponding wall element into an inactive position with said door closer in order to prevent pivoting of said door upon said wall element of said door being in a position other than said closed and partitioned position.

Another feature of the invention resides broadly in a movable partition system comprising: a plurality of wall elements configured to be connected to one another along longitudinal edges to provide a continuous wall-like partition for a space of a building and thus provide a closed position for a space of a building and also to provide an open position upon said wall elements being moved from said closed position, said connected wall elements guided so that they move laterally in association with a support profile, at least one of said connected wall elements comprising a door that can be actuated by means of a door closer; a guide rail configured to be attached to the ceiling of the building space to be partitioned; an arrangement comprising support profiles configured to enclose the upper edges of each wall element to suspend said connected wall elements from said guide rail, the support profile for said door being in two parts, a lower partial profile which is associated with said door and comprises a slide rail and a rotational fitting for pivotally connecting said door to its neighboring wall element, and an upper partial profile which comprises support pins to suspend said door from said guide rail, a door blocking element configured to maintain said door in an inactive status and prevent said door from opening upon lateral movement of said wall elements between said opened position and said closed position and release said door to permit said door to be opened upon movement of said door on its corresponding wall element into an active position with said door closer, and fittings configured to connect said door to its corresponding wall element; one or more drives configured to be associated with said guide rail to move said wall elements laterally to, alternatively, said open and closed positions to partition said space; a door closer comprising a door closer drive which is configured to be stationary with reference to the movable door elements and is configured to be affixed to said guide rail in the vicinity of said door upon lateral movement of said wall elements to partition said space; and an actuation linkage which is configured to be stationary with reference to the movable door elements, configured to be located between said door closer and said door, is capable of engaging with said door closer drive and automatically activating said door closer upon lateral movement of said wall elements to said closed position to provide a partitioning condition, and is capable of disengaging with said door closer drive and automatically deactivating said door closer upon lateral movement of said wall elements away from said closed position.

Yet another feature of the invention resides broadly in the system wherein said linkage comprises a slide rail arm having an integral coupling pin connected to the drive shaft of said door closer drive, said pin being capable of engaging said slide rail mounted on the lower support profile of said door upon lateral movement of said wall elements to a partitioning condition.

Still another feature of the invention resides broadly in the system wherein said linkage comprises a slide rail arm having an integral coupling pin connected to the drive shaft of said door closer drive, said pin being capable of disengaging said slide rail mounted on the lower support profile of said door upon lateral movement of said wall elements to an opening condition.

A further feature of the invention resides broadly in the system wherein said blocking element is a spring-loaded, rotationally-mounted rocker arm.

Another feature of the invention resides broadly in the system wherein a stationary stop is fastened to the guide rail attached to the ceiling and protrudes into the projected path of travel of said rocker arm with respect to said guide rail upon lateral movement of the connected wall elements.

Yet another feature of the invention resides broadly in the system wherein said stop contacts said rocker arm and rotates it to a canted position upon lateral movement of said door into an active position with said door closer which allows pivoting of said door.

Still another feature of the invention resides broadly in the system wherein said stop loses contact with said rocker arm and rotates it to a vertical position upon lateral movement of said door into an inactive position with said door closer which prevents pivoting of said door.

A further feature of the invention resides broadly in the system wherein said upper partial profile also comprises a door stop to arrest the rotational movement of said door upon activation of said door closer.

Another feature of the invention resides broadly in the system wherein said wall elements and said door are fabricated from glass.

Yet another feature of the invention resides broadly in a movable partition system comprising: a plurality of wall elements connected to one another along longitudinal edges to provide a continuous wall-like partition for a space of a building, at least one of said wall elements comprising a door; a guide rail being configured to be attached to the ceiling of the building space to be partitioned; an arrangement comprising support profiles configured to enclose the upper edges of each wall element to suspend said connected wall elements from said guide rail; one or more drives associated with said guide rail to move said wall elements laterally to open or partition said space; a stationary door closer comprising a door closer drive configured to be affixed to said guide rail in the vicinity of said door upon lateral movement of said wall elements to partition said space and form a closed condition partitioning said space; and a stationary linkage configured to activate and deactivate said door closer drive between said drive and said door that is capable of automatically coupling said drive and said stationary linkage upon lateral movement of said wall elements to a partitioning condition or, alternatively, automatically uncoupling them upon lateral movement of said wall elements away from said closed condition to an opening condition.

Still another feature of the invention resides broadly in the system wherein said linkage comprises a slide rail arm connected to the drive shaft of said door closer drive which is capable of engaging or, alternatively, disengaging a slide rail mounted on said door.

A further feature of the invention resides broadly in the system wherein said engaging or disengaging is by means of a coupling pin integral with said slide rail arm.

Another feature of the invention resides broadly in the system wherein the support profile of said door is in two parts, a lower partial profile which is associated with said door and comprises a slide rail and a rotational fitting for pivotally connecting said door to its neighboring wall element, and an upper partial profile which comprises support pins to suspend said door from said guide rail, a door blocking element, and fittings to connect said door to each neighboring wall element.

Yet another feature of the invention resides broadly in the system wherein said door blocking element maintains said door in an inactive status upon lateral movement of said wall elements to an opened condition and releases upon movement of said door into an active position with said door closer.

Still another feature of the invention resides broadly in the system wherein said blocking element is a spring-loaded, rotationally-mounted rocker arm.

A further feature of the invention resides broadly in the system wherein a stationary stop is fastened to the guide rail attached to the ceiling and protrudes into the projected path of travel of said rocker arm with respect to said guide rail upon lateral movement of the connected wall elements.

Another feature of the invention resides broadly in the system wherein said stop contacts said rocker arm and rotates it to a canted position upon lateral movement of said door into an active position with said door closer which allows pivoting of said door.

Yet another feature of the invention resides broadly in the system wherein said stop loses contact with said rocker arm and rotates it to a vertical position upon lateral movement of said door into an inactive position with said door closer which prevents pivoting of said door.

Still another feature of the invention resides broadly in the system wherein said upper partial profile also comprises a door stop to arrest the rotational movement of said door upon activation of said door closer.

The invention as described hereinabove in the context of the preferred embodiments is not to be taken as limited to all of the provided details thereof, since modifications and variations thereof may be made without departing from the spirit and scope of the invention.

NOMENCLATURE

12. Building
12/1–12/n. Wall elements
12/2. Door element
14. Support profiles
14/1, 14/2. Partial profiles
15. Cover profiles
17. Support pin
20. Guide rail
21. Rollers
22. Guide rollers
23. Drive slide
25. Fittings
25/1. Rotational fittings
27. Frame profile
28. Door stop
29. Rocker arm
29/1. Terminal portion
29/2. Spring-biased axle
30. Door closer and drive
32. Slide rail
33. Slide rail arm
35. Drive shaft
37. Coupling pin or stud
38. Stationary stop
47. Control system
48. Drive system
49. Sliding wall elements

What is claimed is:

1. A movable partition system comprising:

a plurality of movable wall elements being configured and disposed to be laterally moved into a closed position to form a partition for a space of a building and being configured and disposed to be laterally moved into an open position to open the space of the building;

a guide rail being configured to be attached to a ceiling of the building space to be partitioned;

each of said wall elements comprising a support profile structure being configured and disposed to suspend said wall element from said guide rail;

a drive system being operatively connected to said wall elements to move said wall elements;

at least one of said wall elements comprising a first wall element;

said first wall element comprising a door;

a stationary door closer being mounted in a stationary manner with respect to the building and comprising a door closer drive;

a stationary linkage being mounted in a stationary manner with respect to the building and being operatively connected to said door closer drive;.

said support profile structure of said first wall element comprising a first portion and a second portion;

said stationary linkage being configured and disposed to engage with one of said first portion and said second portion of said support profile structure of said first wall element to operatively connect said door closer drive with said door upon said wall elements being in the closed position, to form the partition for the space of the building, to enable said door closer to pivot said door from a closed position of said door to an open position of said door; and said support profile structure of said first wall element being configured and disposed to disengage from and be disposed a distance from said stationary linkage upon said first wall element being moved from said closed position of said wall elements.

2. The movable partition system according to claim 1, wherein:

said first wall element comprises a blocking element being configured and disposed to retain said door in the closed position of said door;

said blocking element being configured to be rotationally displaced to release said door upon movement of said first wall element into engagement with said linkage; and said blocking element being disposed on said support profile structure of said first wall element.

3. The movable partition system according to claim 2, wherein:

said blocking element comprises a rotationally-mounted, spring-loaded rocker arm;

said door closer drive comprises a drive shaft;

said door comprises a slide rail;

said stationary linkage comprises a slide rail arm connected to said drive shaft;

said slide rail arm being configured and disposed to be engaged with and disengaged from said slide rail of said door; and said slide rail arm comprises a coupling pin configured to engage and disengage with said slide rail.

4. The movable partition system according to claim 3, wherein:

said first portion of said support profile structure of said first wall element is separate from said second portion;

said first portion is connected to said door and said second portion is suspended from said guide rail;

said slide rail is attached at said first portion;

said wall elements comprise a second wall element and a third wall element disposed on opposite sides of said first wall element;

said first wall element comprises a rotational fitting being configured and disposed to pivotally connect said door to said second wall element;

said rotational fitting is disposed at said first portion;

said rocker arm is disposed at said second portion;

said first wall element comprises fittings to connect said first wall element to said second and third wall elements; and said fittings are disposed at said second portion.

5. The movable partition system according to claim 4, further comprising a stationary stop being fastened to said guide rail and being configured and disposed to protrude into a path of travel of said rocker arm, wherein:

said stationary stop being configured and disposed to contact and rotate said rocker arm to a canted position to release said door to permit opening of said door upon lateral movement of said movable wall elements into said closed position of said wall elements;

said stationary stop being configured and disposed to lose contact with said rocker arm to permit said rocker arm to rotate to a substantially vertical position upon lateral movement of said movable wall elements from said closed position of said wall elements to prevent pivoting of said door; and said second portion of said support profile structure of said first wall element comprises a door stop to arrest the pivotal movement of said door.

6. A movable partition system comprising:

a plurality of movable wall elements being configured to be laterally moved into a closed position to form a partition for a space of a building and being configured to be laterally moved into an open position to open the space of the building;

a guide rail being configured to be attached to a ceiling of the building space to be partitioned;

each of said wall elements comprising a support profile structure being configured to suspend said wall element from said guide rail;

a drive system being configured to be operatively connected to said wall elements to move said wall elements;

at least one of said wall elements comprising a first wall element;

said first wall element comprising a door;

a stationary door closer being configured to be mounted in a stationary manner with respect to the building and comprising a door closer drive;

a stationary linkage being configured to be mounted in a stationary manner with respect to the building and being configured to be operatively connected to said door closer drive;

said support profile structure of said first wall element comprising a first portion and a second portion;

said stationary linkage being configured to engage with one of said first portion and said second portion of said support profile structure of said first wall element to operatively connect said door closer drive with said door upon said wall elements being in the closed position, to form the partition for the space of the building, to enable said door closer to pivot said door from a closed position of said door to an open position of said door; and said support profile structure of said first wall element being configured to disengage from and be disposed a distance from said stationary linkage upon said first wall element being moved from said closed position of said wall elements.

7. The movable partition system according to claim 5, wherein:

said first wall element comprises a blocking element configured to retain said door in the closed position of said door;

said blocking element is configured to be rotationally displaced to release said door upon movement of said first wall element into engagement with said linkage; and said blocking element is configured to be disposed on said support profile structure of said first wall element.

8. The movable partition system according to claim 7, wherein:

said blocking element comprises a rotationally-mounted, spring-loaded rocker arm;

said door closer drive comprises a drive shaft;

said door comprises a slide rail;

said stationary linkage comprises a slide rail arm configured to be connected to said drive shaft;

said slide rail arm is configured to be engaged with and disengaged from said slide rail of said door; and said slide rail arm comprises a coupling pin configured to engage and disengage with said slide rail.

9. The movable partition system according to claim 8, wherein:

said first portion of said support profile structure of said first wall element is separate from said second portion;

said first portion is connected to said door and said second portion is configured to be suspended from said guide rail;

said slide rail is configured to be attached at said first portion;

said wall elements comprise a second wall element and a third wall element configured to be disposed on opposite sides of said first wall element;

said first wall element comprises a rotational fitting configured to pivotally connect said door to said second wall element;

said rotational fitting is configured to be disposed at said first portion;

said rocker arm is configured to be disposed at said second portion;

said first wall element comprises fittings configured to connect said first wall element to said second and third wall elements; and said fittings are configured to be disposed at said second portion.

10. The movable partition system according to claim 9, further comprising a stationary stop being configured to be fastened to said guide rail and being configured to be disposed to protrude into a path of travel of said rocker arm, wherein:

said stationary stop is configured to contact and rotate said rocker arm to a canted position to release said door to permit opening of said door upon lateral movement of said movable wall elements into said closed position of said wall elements;

said stationary stop is configured to lose contact with said rocker arm to permit said rocker arm to rotate to a substantially vertical position upon lateral movement of said movable wall elements from said closed position of said wall elements to prevent pivoting of said door; and said second portion of said support profile structure of said first wall element comprises a door stop configured to arrest the pivotal movement of said door.

11. A movable partition system comprising:

a plurality of movable wall elements being configured to be moved into a closed position to form a partition for a space of a building and being configured to be moved into an open position to open the space of the building;

a guide rail being configured to be attached to a ceiling of the building space to be partitioned;

each of said wall elements comprising a support profile structure being configured to suspend said wall element from said guide rail;

a drive system being configured to be operatively connected to said wall elements to permit movement of said wall elements;

at least one of said wall elements comprising a first wall element;

said first wall element comprising a door;

a stationary door closer being configured to be mounted in a stationary manner with respect to the building and comprising a door closer drive;

a linkage being configured to be mounted in a stationary manner with respect to the building and being configured to be operatively connected to said door closer drive;

said support profile structure of said first wall element comprising a first portion and a second portion;

said linkage being configured to engage with one of said first portion and said second portion of said support profile structure of said first wall element to operatively connect said door closer drive with said the door upon said wall elements being in the closed position, to form partition for the space of the building, to enable said door closer to pivot said door from a closed position of said door to an open position of said door; and said support profile structure of said first wall element being configured to disengage from and be disposed a distance from said linkage upon said first wall element being moved from said closed position of said wall elements.

12. The movable partition system according to claim 11, wherein:

said first wall element comprises a blocking element being configured to retain said door in the closed position of said door; and said blocking element being configured to be displaced to release said door upon movement of said first wall element into engagement with said linkage.

13. The movable partition system according to claim 12, wherein:

said blocking element is configured to be disposed on said support profile structure of said first wall element; and said blocking element is configured to be rotationally displaced.

14. The movable partition system according to claim 13, wherein said blocking element comprises a rotationally-mounted, spring-loaded rocker arm.

15. The movable partition system according to claim 14, wherein:

said door closer drive comprises a drive shaft;

said door comprises a slide rail;

said stationary linkage comprises a slide rail arm configured to be connected to said drive shaft;

said slide rail arm is configured to be engaged with and disengaged from said slide rail of said door; and said slide rail arm comprises a coupling pin configured to engage and disengage with said slide rail.

16. The movable partition system claim 15, wherein:

said first portion of said support profile structure of said first wall element is separate from said second portion;

said first portion is connected to said door and said second portion is configured to be suspended from said guide rail;

said slide rail is configured to be attached at said first portion;

said wall elements comprise a second wall element and a third wall element configured to be disposed on opposite sides of said first wall element;

said first wall element comprises a rotational fitting configured to pivotally connect said door to said second wall element;

said rotational fitting is configured to be disposed at said first portion;

said rocker arm is configured to be disposed at said second portion;

said first wall element comprises fittings configured to connect said first wall element to said second and third wall elements; and said fittings are configured to be disposed at said second portion.

17. The movable partition system according to claim 16, further comprising a stationary stop being configured to be fastened to said guide rail and being configured to protrude into a path of travel of said rocker arm.

18. The movable partition system according to claim 17, wherein said stationary stop is configured to contact and rotate said rocker arm to a canted position to release said door to permit opening of said door upon movement of said movable wall elements into said closed position of said wall elements.

19. The movable partition system according to claim 18, wherein said stationary stop is configured to lose contact with said rocker arm to permit said rocker arm to rotate to a substantially vertical position upon movement of said movable wall elements from said closed position to prevent pivoting of said door.

20. The movable partition system according to claim 19, wherein said second portion of said support profile structure of said first wall element comprises a door stop configured to arrest the pivotal movement of said door.

* * * * *

UNITED STATES PATENT AND TRADEMARK OFFICE

CERTIFICATE OF CORRECTION

PATENT NO. : 6,662,502 B2
DATED : December 16, 2003
INVENTOR(S) : Reinhard Janutta and Ernst Udo Blöbaum It is certified that error appears in the above-identified patent and that said Letters Patent is hereby corrected as shown below:

Column 3,
Line 16, after “in” delete “.”

Column 6,
Line 1, after “Udo”, delete “BL” and insert -- BLÖBAUM, --.
Line 2, before “and” delete “ÖBAUM,”.

Column 12,
Line 21, after “claim”, delete “5,” and insert -- 6 --.

Column 13,
Line 52, after the second occurrence of “said” delete “the”.
Line 54, before “partition” insert -- the --.

Signed and Sealed this

Eleventh Day of May, 2004

JON W. DUDAS
*Acting Director of the United States Patent and Trademark Office*